United States Patent [19]

Kearns

[11] Patent Number: 4,777,671

[45] Date of Patent: Oct. 18, 1988

[54] POWER LIFT TOILET SEAT ASSEMBLY

[76] Inventor: Ronald L. Kearns, Rte. 2, Butler, Ohio 44822

[21] Appl. No.: 16,664

[22] Filed: Feb. 19, 1987

[51] Int. Cl.[4] ..... A47K 13/10

[52] U.S. Cl. ..... 4/251; 4/566

[58] Field of Search ..... 4/251, 561–566; 297/313; 254/93 HP

[56] References Cited

U.S. PATENT DOCUMENTS

| | | | |
|---|---|---|---|
| 3,311,930 | 4/1967 | Bourke | 4/566 |
| 3,473,174 | 10/1969 | Cool | 4/251 |
| 4,185,335 | 1/1980 | Alvis | 4/251 |
| 4,587,678 | 5/1986 | Love et al. | 4/251 |
| 4,629,162 | 12/1986 | Porché | 254/93 HP |

FOREIGN PATENT DOCUMENTS

| | | | |
|---|---|---|---|
| 2117236 | 10/1983 | United Kingdom | 4/564 |

*Primary Examiner*—Henry J. Recla
*Assistant Examiner*—Linda L. Sholl
*Attorney, Agent, or Firm*—Robert E. Stebens

[57] ABSTRACT

A toilet seat assembly is provided having a seat that is pivotably supported at its forward end for swinging movement between substantially horizontal and upwardly inclined positions. A power lift mechanism is incorporated in the assembly and is selectively operable by the user to pivot the seat and support the seat in a desired position for assisting the user in moving between seated and standing positions. The power lift mechanism includes an expandible bladder of the bellows disposed at the rear of the seat assembly between a base structure adapted to be secured on the top of a toilet bowl and the pivoted seat that is also mounted on the base structure. A fluid control system is coupled with the expandible bladder and adapted to be connected with a source of pressurized fluid and has a manually actuated control valve operable by the user to permit admission of pressurized fluid into the bladder to cause its expansion and upward pivoting of the seat or to permit outflow of fluid from the bladder resulting in construction of the bladder and pivoting of the seat towards a horizontal position.

6 Claims, 5 Drawing Sheets

POWER LIFT TOILET SEAT ASSEMBLY

FIELD OF THE INVENTION

The invention relates in general to toilet seat assemblies that are pivotable about their forward end to enable swinging of the seat about a horizontal axis between a horizontal position and a raised, generally vertical position. The invention relates more particularly to the combination of a forwardly pivoting seat assembly and a power mechanism for effecting pivotable displacement of the seat between selected positions.

BACKGROUND OF THE INVENTION

It has been recognized that physically infirm persons or persons having certain physical disabilities experience substantial difficulty in moving between standing and seated positions. Movement from either position to the other requires substantial physical muscular exertion as a consequence of the person's weight and the physical mechanics of a person's skeletal construction so as to effect swinging movement of body members at the hip and knee joints.

This problem, associated with moving between standing and seated positions, has been considered in particular with respect to toilets. Illustrative of apparatus specifically designed for the purpose of alleviating the problem through reducing the muscular effort that would otherwise be required is a structure disclosed in U.S. Pat. No. 4,185,335 granted Jan. 29, 1982 to Robert L. Alvis for an invention titled MOVABLE TOILET SEAT ASSEMBLY. Also illustrative of such apparatus are the structures disclosed in U.S. Pat. No. 3,458,872 granted Aug. 5, 1969 to N. E. Hellstrom and U.S. Pat. No. 3,473,174 granted Oct. 21, 1969 to George Cool. Each of the patents disclose a mechanical assembly designed to be associated with a typical toilet bowl and include a mechanical actuator coupled with the seat for effecting its forward pivotable movement between the selected positions. In each of these illustrative seat assemblies, the mechanical actuator comprises a pair of cylinder and piston units operated by pressurized hydraulic fluid. Each of these seat assemblies function to provide support for a person in moving between seated and standing positions and reduce the physical force that must be exerted by the person.

In the structure disclosed by Cool in his patent, the pressurized fluid is obtained from an electric motor driven hydraulic pump that is incorporated in the system. The disadvantage of an apparatus utilizing electrical power for actuation of apparatus in association with a toilet is recognized by Alvis who specifically points out in his patent the hazards of electrical power in an environment where there is water. Thus, Alvis follows the suggestion of Hellstrom and utilizes the pressurized water system which is also used for operation of the toilet. While the typical water source that supplies water for the toilet operation is a convenient source of pressurized fluid for operation of the lifting mechanisms, each of the Alvis and Hellstrom seat assemblies have a same common mechanical limitation which adversely affects their respective capabilities to perform the intended functions. Water supply systems usually provided in either urban or rural areas are of a relatively low pressure type with the water pressure usually being in the range of 30–60 psi. Cylinder and piston mechanisms capable of providing the necessary mechanical force are relatively expensive components and are selected for economic reasons with the smallest possible size being used in any particular application. Selection of such components is demonstrated in the apparatus shown in either of the Alvis and Hellstrom patents. However, recognizing the differences that may be encountered in the fluid pressures that may be encountered in different water supply systems, it will be readily seen that an apparatus which is designed for operation with water pressures in the upper regions of the indicated wide range will not necessarily work with a water supply system that has a pressure at the lower end of that range. Consequently, it is necessary with such systems to take into consideration the variations in fluid pressures and if a universal seat apparatus is to be designed, and the cylinder and piston units must be selected to provide sufficient force when operating with the lowest of the water pressure that may be encountered. Designing of the system with that criteria then results in selecting larger cylinder and pison units to obtain the necessary operating surface area so as to develop the required mechanical force with the lowest of the water pressures. This means that an apparatus which operates with the lowest pressures expected to be encountered is necessarily more expensive than would otherwise be required where higher pressure water supply systems are available.

The power lift toilet seat assemblies illustrated by each of the Hellstrom, Alvis and Cool patents employ a design in assembly of components which requires a greater force be supplied to effect operation as a consequence of a mechanical force disadvantage that is inherent in such illustrated structures. The cylinder and piston actuators in each instance are interconnected between structural members of the assembly such that the effective moment arm of the force applied by the cylinder and piston unit is substantially less than the moment arm that is associated with the weight of the person utilizing the seat and in particular when the seat is at or more closely adjacent to a horizontal position. When this mechanical disadvantage is coupled with the available water pressure limitation, the mechanical limitations of such assemblies are compounded.

SUMMARY OF THE INVENTION

In accordance with this invention, a power lift toilet seat assembly is provided wherein a forwardly pivoted seat is coupled with a fluid powered actuator which obtains the maximum mechanical advantage and is capable of reliable operation with the wide variations of water pressure found in water systems that supply toilets. The seat assembly includes a base structure mechanically mountable on the upper rim of a toilet bowl and a seat element as pivoted on the base structure for forward pivoting movement. Mechanical operation of the seat is obtained by a pressurized fluid actuator which is located at the rear of the assembly or at a most remote point relative to the pivot point to obtain the optimum mechanical advantage through having a greater effective moment arm than that related to the person's weight.

In accordance with this invention, the mechanical actuator comprises a bellows structure having its walls formed from flexible sheet material and configured to enable folding or expanding of the walls in effecting pivoting of the seat in performance of a lifting or lowering function. The bellows is also configured to have a generally U-shaped configuration in plan view which extends around the rear of the seat assembly and partially forward along the sides. This configuration obtains a relatively large surface area that is effective in cooperating with the fluid pressure that is developed within the bellows assembly. utilization of a bellows-type actuator having this configuration enables the assembly to operate with minimal water system pressures that may be encountered in typical supply systems and may be readily constructed to provide a mechanical actuating force that is more than adequate to meet the demands placed on the apparatus by even the heaviest persons that would be encountered. With the large effective surface area that can be achieved by a bellows construction of this nature, it is possible for the apparatus to operate with a fluid pressure that is even substantially less than the normally expected minimum system pressures. With the dimensional design and configuration of the bellows resulting in capability to operate with a water pressure that is substantially lower than the minimum expected water system pressures, the bellows may be readily constructed from materials such as polypropylene plastics which would not develop sufficient strength when formed in wall thicknesses that would permit proper flexing if the relatively higher pressures of typical water supply systems were utilized.

A fluid control system is provided to enable the selective operation of the seat assembly. The fluid control system is manually operated by the user who may readily operate the mechanism to effect raising or lowering with the capability to hold the seat at any selected pivoted position between a lowermost or substantially horizontal position and any upwardly pivoted position to the maximum of a nearly vertical orientation.

The power lift seat assembly of this invention is of a design and construction to be readily mounted on conventional toilet bowls without any modification or additional structural support mechanisms. The seat assembly includes a base structure which is adapted to be bolted to a typical toilet bowl by mounting bolts or similar fastening devices that are used in securing of a conventional seat structure. Interconnection of the fluid system with the pressurized water source that also supplies the toilet itself for its functioning is of a simple mechanical nature and results in simplified installation.

These and other objects and advantages of the power lift toilet seat assembly of this invention will be readily apparent from the following detailed description of an illustrative embodiment that is shown in the accompanying drawings.

DESCRIPTION OF THE DRAWING FIGURES

DESCRIPTION OF THE ILLUSTRATIVE EMBODIMENT

Figure 1:
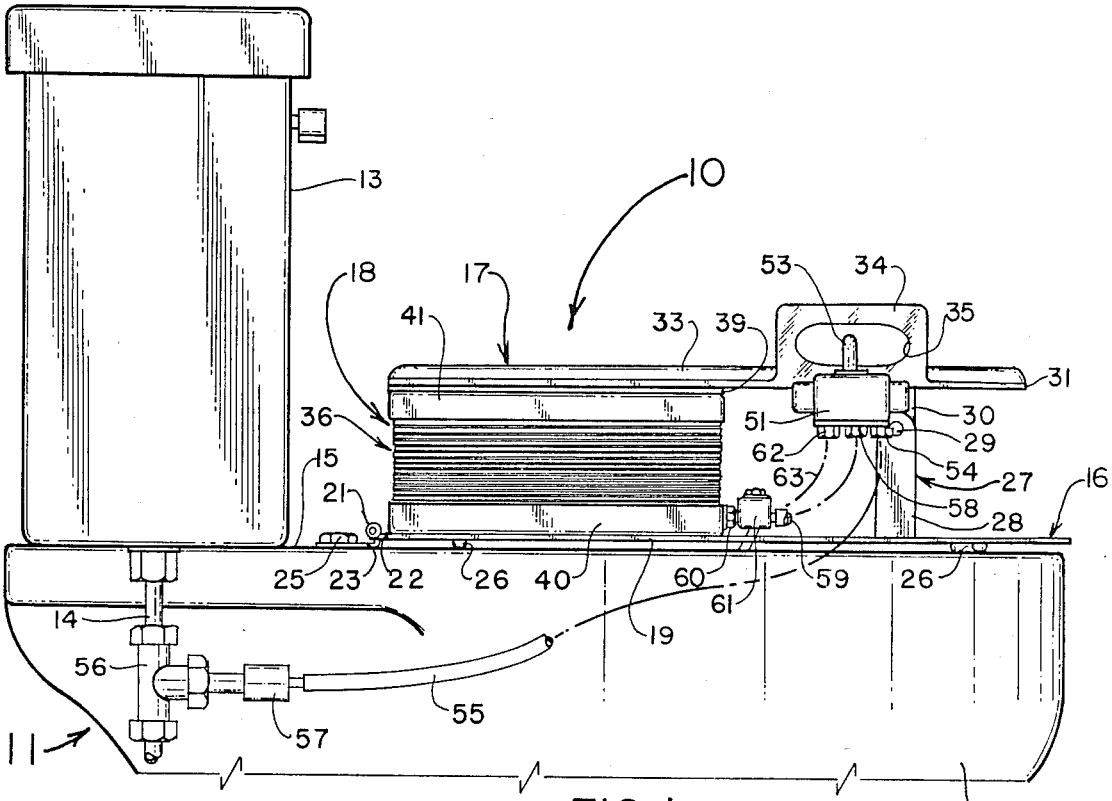
FIG. 1 is a side elevational view of a power lift toilet seat assembly embodying this invention and shown mounted on a typical toilet bowl provided with a flush tank.

Having reference to the drawings, the power lift toilet seat assembly 10 embodying this invention is shown mounted on a toilet 11 of conventional construction. A toilet of this conventional construction includes a base or bowl 12 and is provided with a flush tank 13 for storage of the necessary quantity of water for a flushing operation. Components of the flush tank and specific structural configurations of the bowl are not shown or otherwise described as they are deemed well-known. For purposes of describing the illustrative embodiment of the toilet seat assembly of this invention, it is considered adequate to point out that the flush tank 13 is adapted to be connected with a pressurized water supply source by means of a conduit 14 with only a short section of this conduit shown to illustrate its interconnection with the seat assembly of this invention and details of the interconnection of that conduit to the water supply are not shown. The bowl 12 includes a rear portion having a flat upper surface 15 on which the flush tank 13 is mounted and also forms a mounting surface for a conventional toilet seat assembly. This surface 15 continues forwardly and forms the upper peripheral rim of the bowl.

It will be noted that while the toilet 11 that is illustrated is of a conventional type that is commonly found in residences, the invention may be applied to toilets that are of the type frequently found in commercial buildings. The toilets found in commercial buildings usually do not have the flush tank, but are provided with a water supply that is controlled by a flush valve what performs the flushing operation. For such a toilet structure, the interconnection of the toilet seat assembly of this invention would be made by an appropriate plumbing connection to obtain the pressurized water from the same source. The structure and interconnection would be by conventional plumbing elements and components and by means that would be apparent and known to those skilled in the plumbing art and thus are not illustrated or described.

Figure 2:
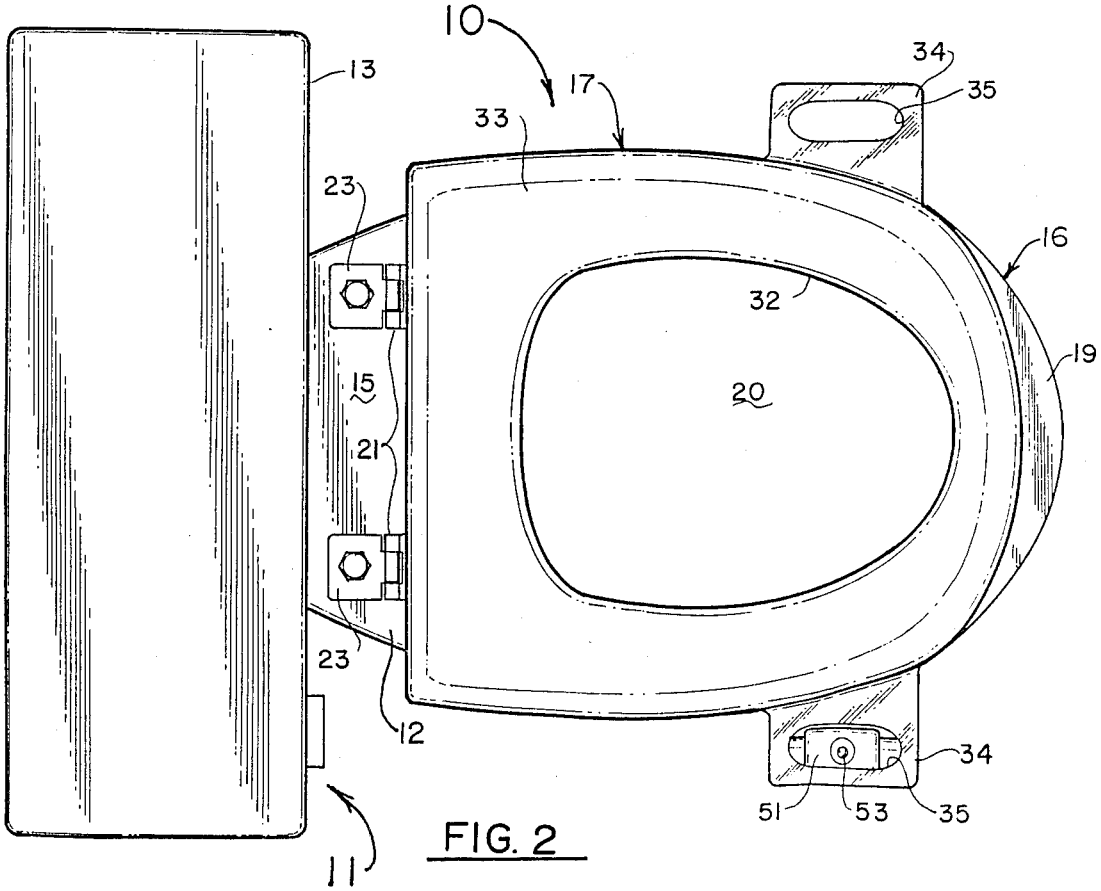
FIG. 2 is a top plan view thereof.
Figure 3:
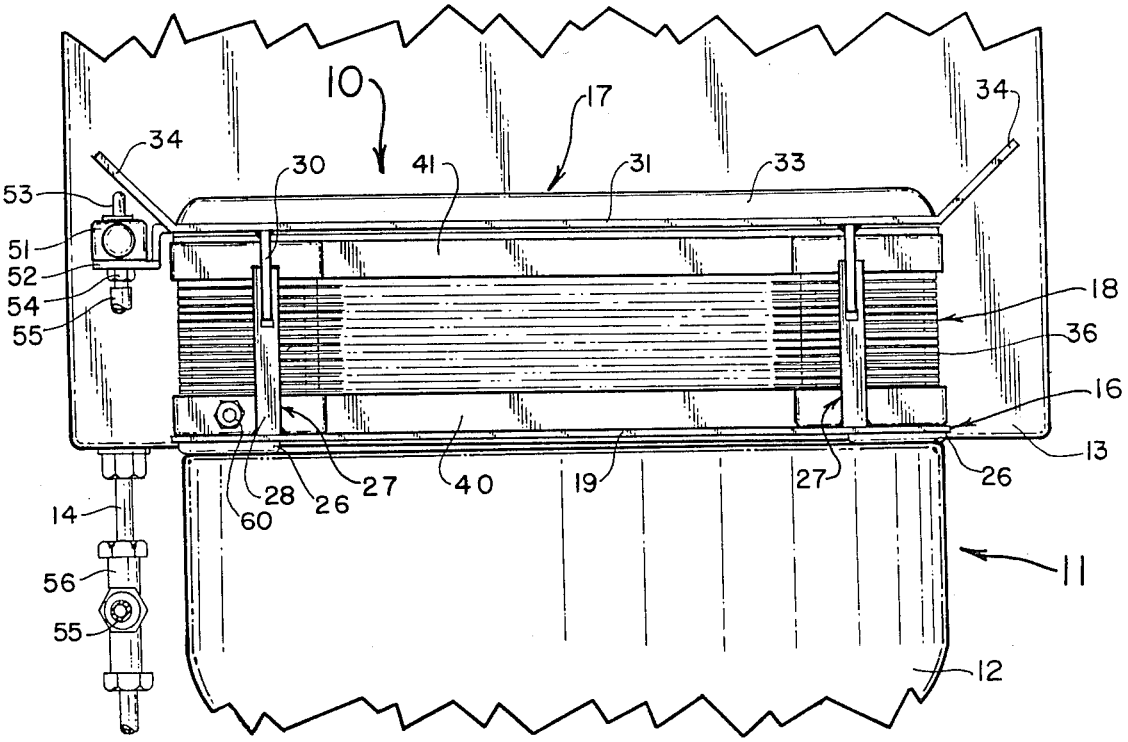
FIG. 3 is a front elevational view as seen from the right side of FIG. 1, but on a slightly enlarged scale and with only a fragmentary portion of the flush tank shown.
Figure 4:
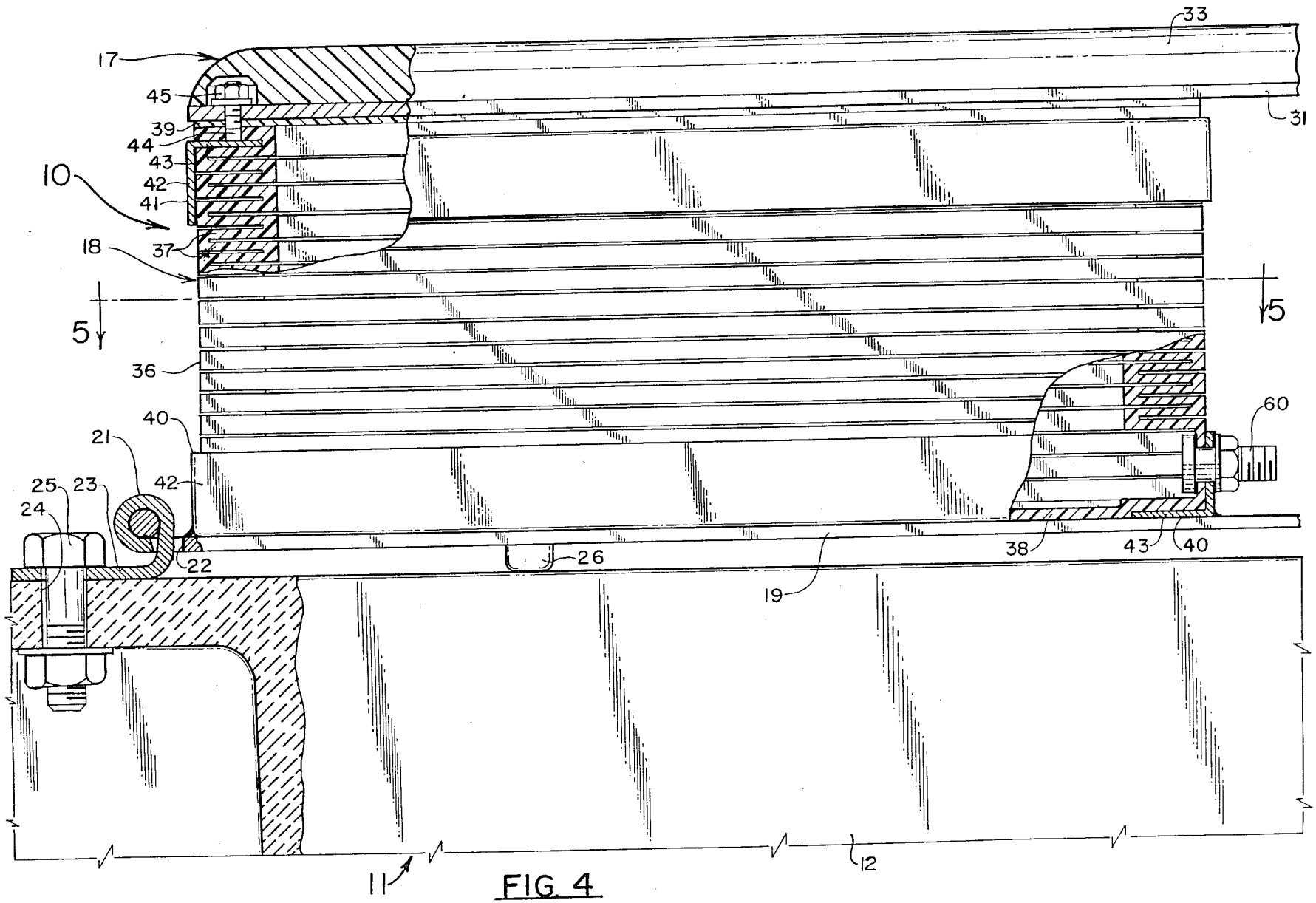
FIG. 4 is a fragmentary side elevational view of the rear portion of the seat assembly on a substantially enlarged scale and with portions of the structure broken away for clarity of illustration.
Figure 5:
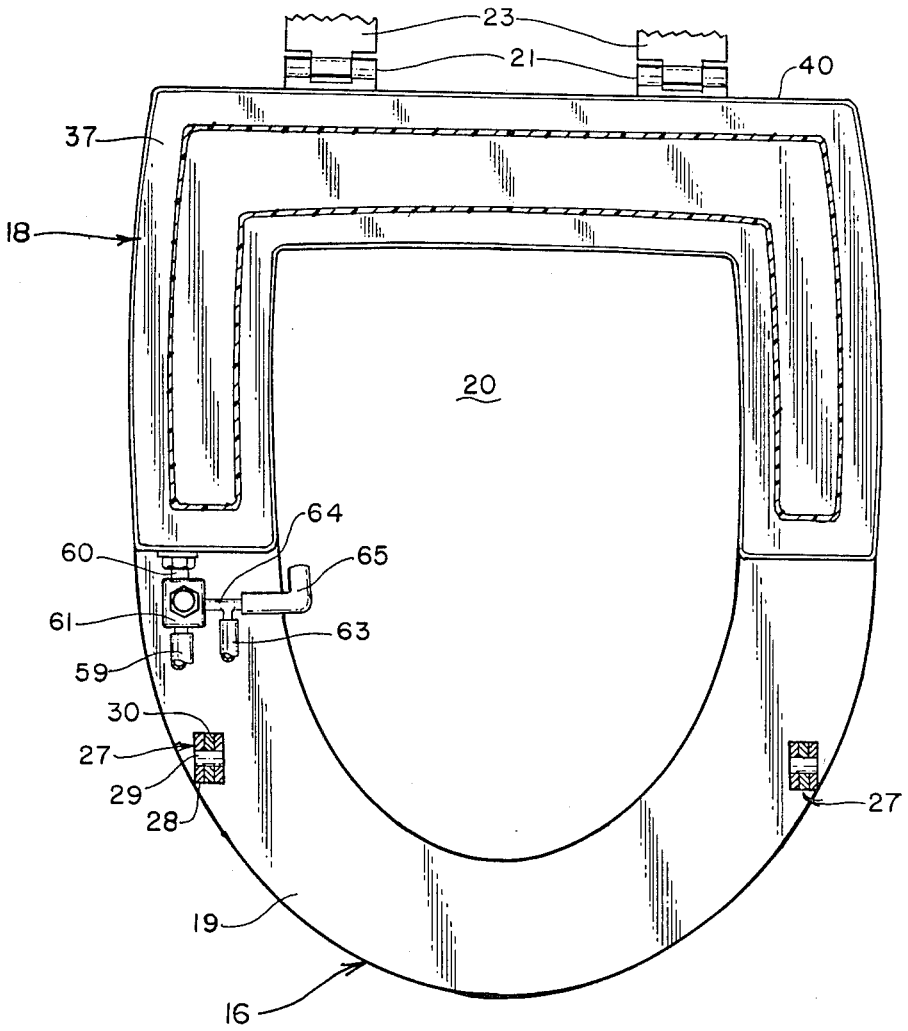
FIG. 5 is a sectional view on a reduced scale taken along line 5—5 of FIG. 4.

The power lift toilet seat assembly 10 includes as the basic elements thereof a base structure 16, a seat 17 and a hydraulically powered actuator 18. The base structure 16 includes a mounting plate 19 which may be fabricated from a flat metal plate that is a thickness to provide adequate structural rigidity. This plate 19 is of a configuration that generally conforms to the typical shape of the upper rim of a toilet bowl having a central opening 20 as can be seen in FIGS. 2 and 5. The mounting plate 19 is advantageously secured to the bowl 12 by a pair of hinge assemblies 21. These hinge assemblies 21 are secured to or integrally formed with the plate 19 at a rear edge 22 in transversely spaced relationship such that an attachment Plate 23 of each hinge assembly overlies a respective bolt hole 24 formed in a conventional manner in the upper portion of a toilet bowl 12. This structure, as can be best seen in FIG. 4, provides for mounting of the seat assembly of this invention in the same manner as a conventional seat by means of a bolt-type fastening devices 25. Providing the hinged mounting as shown is advantageous in that it facilitates cleaning as the seat assembly may be pivoted in a substantially similar manner as a conventional seat in an upward and rearward direction to provide access to the interior of the toilet bowl. It will also be noted that rubber or rubber-like cushion elements 26 are provided on the bottom surface of the mounting plate 19 in spaced relationship to engage with the upper surface of the bowl as is conventional with toilet seats.

Provided at the forward end of the base structure 16 are a pair of hinged supports 27 which provide support to maintain the seat 17 in vertically spaced relationship to the mounting plate 19 and to enable pivoting of the seat in a forward direction. In the illustrative embodiment shown in the drawings, this spacing is of the order of four inches when the seat is in a horizontal position. Each of these hinge supports 27 includes an upstanding post 28 which is pivotally connected by a hinge pin 29 to an attachment lug 30 secured to the seat 17. The post 28 which may be secured to the mounting plate 19 as by welding is a substantially greater length than the attachment lug 30 so as to locate the pivot axis defined by the hinge pin 29 in relatively closely spaced relationship to the seat 17. It will be noted that the seat 17 is constructed to include a support plate 31 which is advantageously formed from a flat sheet of steel as is the mounting plate 19 of the base structure. The attachment lug 30 may thus also be secured to that support plate as by welding.

The support plate 31 of the seat 17 is of a configuration that is substantially the same as that of the mounting plate 19 of the base structure although its forward end does not extend as far forward so as to enable the seat to pivot to a nearly vertical position. The seat also has a central opening 32 which may have a slightly different configuration than the opening that is formed in the mounting plate. A cushion-type seat cover 33 is desirably positioned on the top surface of the support plate 31. Positioned adjacent the forward end of the seat 17 at opposite sides are a pair of handles 34 which are designed to be gripped by the user for reasons of safety and to facilitate utilization. The handles 34 may be integrally formed with the support plate 31 and project a distance laterally outward and upwardly with respect to that plate. Each handle is also provided with an aperture 35 through which a person's fingers may extend.

Figure 6:
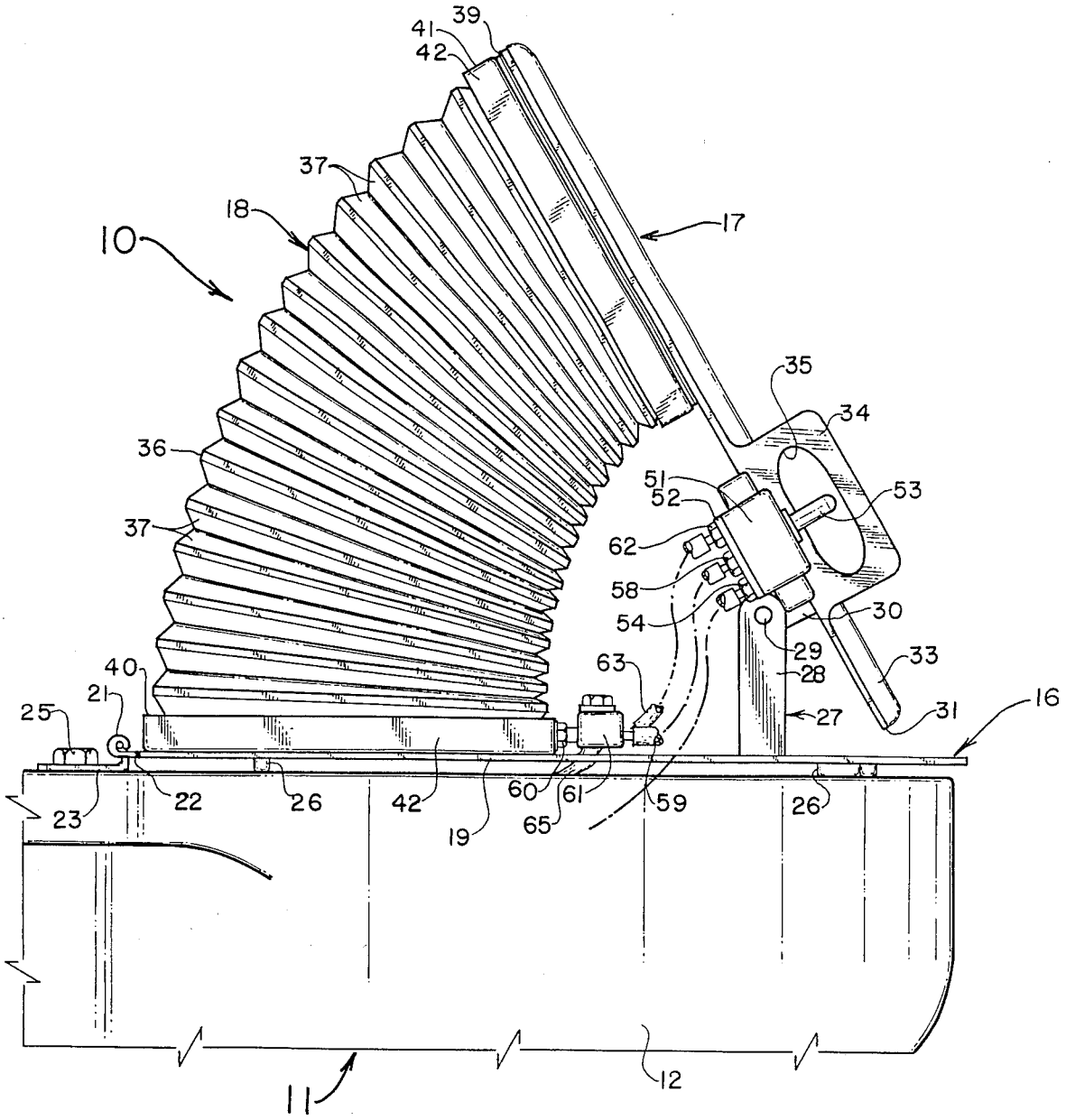
FIG. 6 is a fragmentary side elevational view similar to that of FIG. 1, but showing the seat assembly operated to an upwardly pivoted position.

Pivoting of the seat 17, as well as support of the seat in any selected position, is effected by the hydraulically powered actuator 18. This actuator is an expansible bladder of a bellows-type interposed between the mountng plate 19 and support plate 31 of the base structure and seat, respectively. It is located at the rear portion of the seat assembly and is caused to expand by admission of pressurized water to its interior to effect pivoting of the seat 17 to an upwardly inclined position such as that which is shown in FIG. 6. The extent of the upward inclination of the seat 17 may be greater or less than that shown in FIG. 6 as is desired by the user of the seat assembly.

Specifics of the mechanical structure of the actuator 18 can be best seen by reference to FIG. 4 and also to FIG. 5. FIG. 5, it will be noted, is a sectional view which includes a top plan of the forward portion of the mounting plate 19 although that forward portion is not shown in FIG. 4. As indicated, the actuator 18 is of a bellows-type comprising a closed chamber having a side wall 36 that is formed from a flexible material. This material may be of a synthetic resin such as polypropylene or it may be formed from a rubber-like material. The side wall 36 is molded to have a number of peripheral elements 37 that will overlap when the bellows is in a relatively collapsed configuration such as that which is shown in FIG. 4. Referring to FIG. 5, it will be seen that the configuration of the actuator is of a generally U-shape in plan view. That configuration is particularly designed to conform with the mounting plate 19 with portions extending forwardly along the upper surface of the mounting plate. These forwardly extending portions terminate approximately midway of the longitudinal length of the seat assembly.

Referring again to FIG. 4, it will be seen that the bellows is fabricated in two sections. The one section includes the side walls 36 which have an integrally formed bottom wall 38. The upper end of this bottom section is open and is provided with a sheet 39 of similar material and forms a fluid tight structure. It is to be understood that this illustrated and described bellows construction is illustrative and other bellows constructions may be employed such as molding of the bellows in one piece and using other materials for its fabrication with perhaps different wall thickness as may be appropriate for a particular material.

To secure the bellows to the base structure and seat 16, 17 respective retaining rings 40 and 41 are provided at the bottom and top of the bellows. Each of the retaining rings 40, 41 extends around the bellows and is mechanically secured to the respective plate 19 and 31 of the base structure and seat. Each of the rings is formed from a structural element having an L-shaped cross-sectional shape having respective vertical and horizontal flanges 42, 43, thus forming a cup shaped structure in which a respective end portion of the bellows is positioned and is thereby retained. The rings are mechanically secured to the respective plate such as by welding of the bottom ring 40 to the plate 19 and bolting of the top ring 41 to the support plate 31. Fastening means in the form of a plurality of threaded bolt elements 44 may be secured to the inwardly projecting horizontal flange 43 of the top ring 41 in spaced relationship around the ring and extend through aligned apertures in the sheet 39 and plate 31 with a nut 45 threaded on the upper end to effect clamping of the ring to the seat 17 as well as securing the bellows top cover sheet 39.

Figure 7:
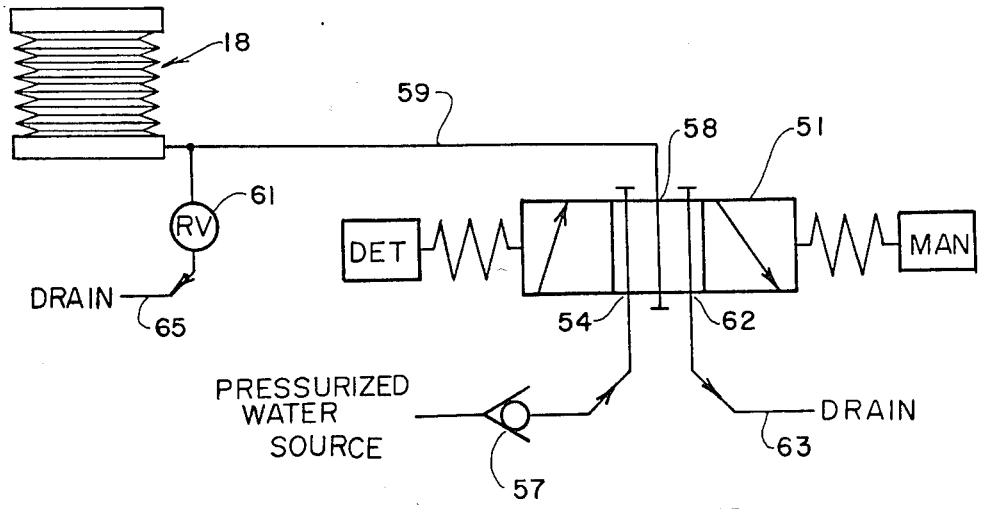
FIG. 7 is a schematic diagram of the fluid control system.

Operation of the actuator 18 is effected through a fluid control circuit 50 which is schematically shown in FIG. 7 with several of the components thereof shown mounted on the seat assembly as can be seen in other drawing figures. Operation of the seat assembly is under the selected control of the person using the seat and for that purpose a manually operated valve is provided in physically close relationship to one of the handles 34. This control valve 51 is secured to the mounting plate 31 by a bracket 52 which positions this valve in a location such that an actuating lever 53 is at a position where it can be readily manipulated by a person who is also holding onto the handle 34.

As previously indicated, the seat assembly is designed to utilize the same pressurized water source as that which supplies water to the flush tank. The control circuit is designed to selectively permit water to be either admitted to the actuator and cause expansion or to permit water to be drained from the actuator and result in its contraction. Accordingly, the control valve 51 is of a three position-type which in a center or neutral position will block fluid flow from the water supply system as well as block flow out of the actuator. An inlet port 54 is connected by a conduit to the pressurized water supply conduit 14. Interconnection of the conduit 55 is readily accomplished by insertion of a T-fitting 56 in the conduit 14. A check valve 57 may be included in this circuit to prevent a reverse flow of water from the seat assembly into the pressurized water system to meet requirements that may exist in some building codes. An outlet port 58 of valve 51 is connected by a conduit 59 to a connector fitting 60 that is coupled with the actuator 18. A relief valve 61 is coupled with this conduit 59 and is operable to limit the water pressure that is applied to the actuator. The relief valve 61 is of a type that may be selectively set and it is contemplated that a setting of 10 psi will be appropriate for operation of the apparatus. A second outlet port 62 of the valve 51 connects to a drain conduit 63 which, for convenience, may interconnect with a drain outlet 64 of the relief valve 61 with both being coupled with a discharge tube 65. The discharge tube 65 extends into the interior area of the toilet bowl for discharge of the water into the bowl.

In operation of the fluid control circuit 50, the valve 51 is maintained in a centered or neutral position, but is operable to be placed in either of its two operating states by actuation of the actuating lever 53. In one position, the valve will connect the inlet port 54 to its outlet port 58 and thus pressurized water will be permitted to flow to the actuaor and cause its expansion. When placed in the second position, the valve will connect the two outlet ports 58 and 62 and permit water to flow out of the actuator and to the drain 63, thus permitting the actuator to collapse. The control valve 51 may be of a spring centered type and provided with a detent to assure that until such time as it is operated, it will remain in the center position and block the conduits interconnected therewith and prevent water flow.

With an actuator of the bellows type as is illustrated, the seat assembly is capable of exerting a substantial force to meet the weight requirements and to reliably operate with a relatively low water pressure. Constructing the actuator in the configuration as is illustrated results in a relatively large surface area and thereby enables utilization of a relatively low water pressure. For example, the structure has a dimensional configuration such that the bellows is of the order of 15" extending transversely across the rear of the assembly with each of the forwardly extending legs having a length of the order of 9". The nominal width of the bellows may be of the order of 3½", thus resulting in a surface area of the order of 90 square inches. Application of a pressure of 10 psi is thus seen to apply a net effective force in the range of 900 pounds. Application of that force combined with the advantageous location of the point of application of the force being at the rearwardmost point to the pivot enables the seat assembly to accommodate persons who may be relatively heavy. While the bellows-type actuator 18 is capable of exerting a substantial force, it is also advantageous to locate the hinged supports 27 for the seat 17 in the most rearward as practical position. The advantage of a more rearward position is to reduce the effective moment arm of the person's weight, thereby enhancing the mechanical advantage of the actuator 18 disposed at the rear of the assembly.

In utilization of the seat assembly, the user first operates the control valve 51 to cause the seat 17 to be pivoted to a desired upwardly inclined position. When the seat is positioned as desired, the valve actuating lever 53 is released and the seat will remain in that inclined position. The user then may lean back onto the seat and then operate the valve 51 to permit water to flow out of the actuator. The weight of the person will cause the water to flow out and the rate of outflow will be determined in part by a sizing of the conduit. By appropriately selecting a conduit size, the rate of flow can be limited so that the seat will lower at a predetermined rate that will result in safely lowering the person to a seated position. For a reverse operation in lifting or elevating or otherwise assisting the person to a standing position from a seated position, the valve actuating lever 53 is placed in position to permit water to flow into the actuator. Again, appropriate sizing of the conduits such as 55 limits the rate of flow so that the lifting operation will proceed at a rate that will produce safe operation. The forward pivoting of the seat 17 can be terminated at any point where the user has obtained sufficient lifting movement so that the user can easily return to a standing position.

It will be readily apparent from the foregoing description of an illustrative embodiment of this invention that a power lift toilet seat is provided having the capability of effective operation with a low pressure water system. Utilization of a bellows-type actuator results in a structure having a large surface area upon which the pressurized fluid acts to generate a relatively large force to effect lifting or support of a person using the seat. Locating the actuator at the rear of the seat obtains the further mechanical advantage of a greater moment arm through which the actuator force operates as compared to the moment arm through which the user's weight operates. The bellows-type actuator is economically advantageous and capable of substantial extension for effecting operation of the seat when located relatively remote to the pivot axis of the seat.

Through appropriate configuration of the bellows and dimensioning of the side wall elements 37, the bellows when in a fully collapsed configuration will provide mechanical support for the seat 17 in cooperation with the hinged supports 27. With peripheral side wall elements 37 of the illustrative thickness, the elements will overlie each other forming a structurally supportive wall. If additional structural support is desired, a mechanical stop or support (not shown) may be provided at the rear of the assembly.

having thus described this invention, what is claimed is:

1. A power lift toilet seat assembly comprising a base structure adapted for mounting on a toilet bowl in fixed relationship thereto, a toilet seat mounted on said base structure to extend when disposed in a first position in a substantially horizontal plane over said base structure, said toilet seat pivotably secured to said base structure for swinging movement in a vertical plane about a substantially horizontal pivot axis that extends transversely to a longitudinal axis of a toilet bowl on which the seat assembly is mounted between said first position and a second position angularly disposed to said position, said pivot axis disposed adjacent a forward end of said base structure, and fluid powered actuator means mechanically interconnected between said base structure and said toilet seat for effecting relative pivoting movement therebetween, said actuator means including a flexible-walled bladder disposed between said base structure and said toilet seat in rearwardly disposed relationship to said pivot axis and expandible between a relatively collapsed configuration when said seat is disposed in said first position and a proportionally expanded configuration when said seat is pivoted to a second position, and fluid circuit means connected in fluid communicating relationship with bladder for effecting expansion or contraction thereof to cause pivoting of said seat to a selected position said fluid circuit means including a control valve selectively operable to control the flow of fluid to or from said bladder, said base structure and seat are each formed with a central open area and have transversely extending rear end portions and side portions that are substantially superposed when said seat is in said first position, said bladder interposed between the respective rear end portions of said base structure and said seat.

2. A seat assembly according to claim 1 wherein said fluid circuit means is adapted for interconnection with a pressurized fluid source.

3. A seat assembly according to claim 2 wherein said control valve is selectively operable to permit a flow of pressurized fluid into said bladder to effect expansion thereof or to permit fluid to flow out of said bladder thereby enabling its contraction.

4. A seat assembly according to claim 1 wherein said pivot axis for said seat is disposed a predetermined distance above said base structure whereby said seat when disposed in said first position will be maintained in a relatively elevated position with respect to said base structure.

5. A seat assembly according to claim 1 wherein said bladder extends substantially across the rear end portions of said base structure and said seat.

6. A seat assembly according to claim 1 wherein said bladder is of U-shaped configuration in plan view extending substantially across the rear end portions of said base structure and said seat and extending a distance forwardly from said rear portion between said side portions.

* * * * *